United States Patent [19]

Grady

[11] 4,169,492

[45] Oct. 2, 1979

[54] SHUTTLE BOX FOR LOOMS

[75] Inventor: Raymond J. Grady, Albany, N.Y.

[73] Assignee: Huyck Corporation, Wake Forest, N.C.

[21] Appl. No.: 890,265

[22] Filed: Mar. 27, 1978

[51] Int. Cl.[2] ..... D03D 49/56

[52] U.S. Cl. ..... 139/185; 139/187

[58] Field of Search ..... 139/183, 184, 185, 186, 139/187

[56] References Cited

U.S. PATENT DOCUMENTS

| | | | |
|---|---|---|---|
| 1,068,823 | 7/1913 | Ryon | 139/186 |
| 2,818,884 | 1/1958 | Sherwood | 139/186 |
| 3,190,318 | 6/1965 | Picanol | 139/187 |
| 3,596,684 | 8/1971 | Miller | 139/187 |
| 3,868,975 | 3/1975 | Stahl et al. | 139/1 R |

FOREIGN PATENT DOCUMENTS

| | | | |
|---|---|---|---|
| 814875 | 9/1951 | Fed. Rep. of Germany | 139/185 |
| 1130376 | 10/1968 | United Kingdom | 139/187 |

*Primary Examiner*—Henry Jaudon
*Attorney, Agent, or Firm*—Frost & Jacobs

[57] ABSTRACT

An improved shuttle box for use on a loom, the box having one or more shuttle receiving cells each containing an elongated binder which is adjustably mounted and pivotally movable under fluid pressure from a retracted position to an extended shuttle engaging position, the binder, upon contact by the shuttle, acting to provide controlled deceleration of the shuttle as opposed to impact stoppage of the shuttle, the shuttle box being constructed of non-metallic materials which act to dampen noise, the binder components and the fluid pressure applying means being cushioned to assist in noise reduction.

12 Claims, 2 Drawing Figures

SHUTTLE BOX FOR LOOMS

This invention relates to looms has to do more particularly with an improved loom shuttle box which acts to gradually decelerate the shuttle as it is received in the shuttle box.

BACKGROUND OF THE INVENTION

As commonly constructed, a loom is provided with one or more shuttles which are propelled by picking mechanism back and forth between shuttle boxes located on the opposite sides of the loom, the loom having an oscillating lay mounting a race plate over which the shuttles travel. The shuttle boxes are designed to receive and stop the shuttles after they travel across the loom, the boxes also serving to guide the shuttles as they are being picked or propelled across the loom.

Some looms have single shuttle boxes on each side which restrict weaving to the use of a single shuttle traveling back and forth. Other looms employ shuttle boxes having a plurality of shuttle receiving cells mounted one above the other for receiving a plurality of shuttles, thereby permitting the use of different colored yarns and the formation of pattern effects in the fabric being woven. The shuttle boxes are shifted in a sequence determined by a device known as a pattern chain, the boxes being raised and lowered to position the various cells in active position to obtain the desired effects.

Generally speaking, the shuttles have heretofore been stopped by impact, movement of the shuttle being arrested primarily by a loom check positioned immediately beyond the shuttle box. Since a very considerable force is required to propel the shuttle across the loom, the impact forces are quite high and tend to disturb the filling package within the shuttle. While efforts have hitherto been made to reduce the impact by providing binders in the shuttle boxes adapted to engage and retard the speed of the shuttle, such binders were difficult to adjust and maintain in adjustment, and generally were not effective to adequately overcome the impact forces.

Another problem inherent in shuttle boxes of knwon construction is their relatively high noise level, which has become of increasing concern in view of government regulations relating to factory noise levels.

The present invention seeks to overcome the objectionable features of presently known shuttle boxes by providing shuttle boxes which effectively retard the speed of the shuttle as it enters the shuttle box, thereby materially reducing the impact force. In addition, shuttle boxes in accordance with the present invention reduce the noise created by the shuttle as it is brought to a stop.

SUMMARY OF THE INVENTION

In accordance with the present invention, the shuttle box, which may be composed of one or more cells, depending upon the number of shuttles being used, is provided with an elongated binder in each cell, the binders being adjustably mounted and movable pneumatically or hydraulically from a shuttle engaging position to a shuttle releasing position.

Each binder has a shuttle contacting leaf having a tapered surface at its outermost or leading end, the remainder of the leaf comprising a planar surface adapted to lie in generally parallel spaced relation to the rear wall for the shuttle box, thereby defining a shuttle receiving channel or cell therebetween. At its trailing end, the binder is mounted on a pivot link which permits the binder to float and align itself with the shuttle as the shuttle enters the cell.

The binder is normally biased in the direction of the rear wall of the shuttle box by means of a pair of pneumatic or hydraulic cylinders one of which is located toward the leading tapered end of the binder and the other located adjacent its trailing end in the area of the pivot link. The cylinders have piston rods which bear against the binder and normally urge it in the direction of the rear wall of the shuttle box, the binder being adjusted so that the distance between the planar portion of its leaf and the rear wall of the shuttle box is slightly less than the width of the shuttle.

As the shuttle enters the shuttle box it initially contacts the tapered leading portion of the binder leaf, the binder leaf being displaced angularly about the pivot link at its trailing end, the displacement of the binder being resisted by the pressure applying cylinders. Preferably, an adjustable pin covered with an energy absorbing material, such as rubber bushings, is mounted in back of the binder leaf in the area of its tapered leading portion to further absorb shocks generated by the shuttle as it enters the box. As the shuttle progresses further into the box and comes in contact with the planar portion of the leaf, the binder is displaced angularly such that the pivot link is rotated in a clockwise direction, the rotation of the pivot link being resisted by the cylinder acting on the pivot link. Thus, the frictional force component acting parallel to the planar portion of the binder in contact with the shuttle is transferred through the pivot link, and the cylinders coact to provide resilient cushions counteracting the forces generated by the shuttle. With this arrangement, the binder leaf and the cylinders drain energy from the shuttle and contribute to its smooth deceleration.

In order to obtain noise reduction, the shuttle box is preferably constructed from a high pressure phenolic resin and linen laminate or other plastic material having the necessary strength characteristics, the various parts of the box being cut from sheet stock and fabricated utilizing machine screws, thereby permitting the repair or replacement of the parts without use of special tools or equipment. By fabricating the shuttle boxes in this fashion the need to carry spare boxes is eliminated and it is necessary to inventory only a small number of replacement parts.

The binder itself is preferably formed from sheet aluminum which is bent to provide a desired configuration for the shuttle contacting leaf and also a rear leaf, the trailing ends of the leaves being secured to an aluminum fitting which pivotally connects the binder to its pivot link. The front or shuttle contacting leaf of the binder is preferably covered with a strip of leather to provide a cushioned contacting surface for the shuttle. While aluminum is preferred the binder may be fabricated from other materials, such as plastic.

Accordingly, a principal object of the invention is the provision of an improved shuttle box which materially reduces the impact forces generated by the shuttle, the construction providing a gradual deceleration of the shuttle rather than impact type stopping.

Another object of the invention is the provision of a shuttle box construction in which the impact forces of the shuttle are absorbed by fluid loaded cylinders acting against the binder, a further object of the invention being the provision of a binder which can be fluid loaded and adjusted while the loom is running, the pressure at each end of the binder preferably being independently adjustable to obtain optimum operating conditions.

A further object of the invention is the provision of a shuttle box construction which is easy to repair and maintain, the binder and all normal wearing box guide parts being replaceable without removing the box from the loom or disturbing its alignment.

Still a further object of the invention is the provision of a shuttle box constructed from materials having sound deadening properties which reduce the noise generated as the shuttle is received in the box.

The foregoing objects as well as others which will appear hereinafter or which will be apparent to the worker in the art upon reading this specification, are accomplished by a construction and arrangement of parts which will be described in detail hereinafter.

DESCRIPTION OF THE PREFERRED EMBODIMENTS

Figures 1, 2:
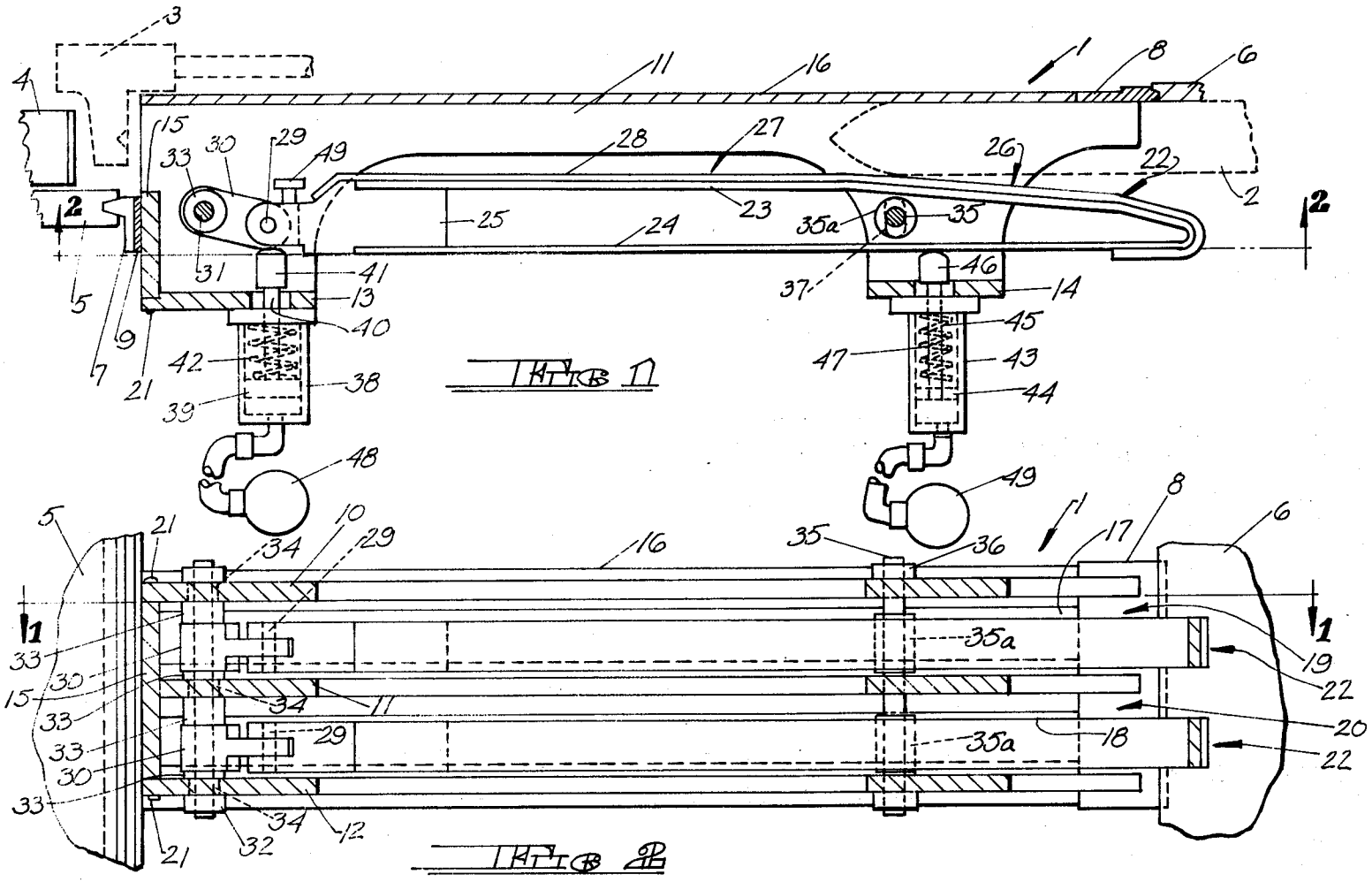
FIG. 1 is a plan view taken along the line 1—1 of FIG. 2 showing a shuttle box constructed in accordance with the invention.
FIG. 2 is a vertical sectional view taken along the line 2—2 of FIG. 1.

Referring first to FIG. 1 of the drawings, a shuttle box is indicated generally at 1, the box being adapted to receive a shuttle 2 (shown in dotted lines) which, in normal operation, is picked from one side of the loom to the other by means of pickers, as will be understood by the worker in the art. A picker (also shown in dotted lines) is indicated at 3, the picker illustrated being used to propel the shuttle from the box 1 to the opposite side of the loom. The picker, which is of conventional construction, coacts with a resilient loom check 4 to stop the shuttle. The shuttle box is normally mounted on metal guides 5 and 6 secured to the loom, the guides permitting vertical movement of the shuttle box in the event it contains multiple cells.

In accordance with the present invention, the shuttle box 1 is mounted on the guides 5 and 6 by means of non-metallic guides 7 and 8 forming a part of the shuttle box, the non-metallic guides, which may be fabricated from plastic, serving to eliminate the metal-to-metal contact and resultant noise inherent in conventional shuttle boxes. If desired, the non-metallic guides may be further cushioned by means of rubber pads, such as the pad 9 lying between guide 7 and the adjacent wall of the shuttle box.

The shuttle box illustrated has two cells, although it will be understood that the number of cells does not constitute a limitation on the invention and will be dependent upon the number of shuttles being used. As seen in FIG. 2, the shuttle box has top wall or shelf 10, a middle wall or shelf 11 and a bottom wall or shelf 12 secured to vertically disposed front wall members 13 and 14 and end wall member 15. The box also has a rear wall 16, the rear wall having a longitudinally extending slot 17 lying between top and middle shelves 10 and 11, and a similar slot 18 lying between middle shelf 11 and bottom shelf 12. In this connection, it will be understood that the top shelf 10 and middle shelf 11 define a shuttle receiving channel or cell 19 therebetween; and similarly, a second shuttle receiving cell 20 is defined between middle shelf 11 and bottom shelf 12. The slots 17 and 18 permit movement of the pickers lengthwise through the cells as an incident of picking the shuttles to the opposite side of the loom.

Preferably the walls and shelf members of the shuttle will be fabricated from non-metallic materials, such as a high pressure phenolic resin and linen laminate, the walls and shelf members being readily fabricated from sheet stock and joined together by machine screws, several of which are indicated at 21, thereby providing a shuttle box construction which is easy to fabricate as well as repair. Any member which breaks or is worn can be easily replaced without the use of special tools or equipment. The high pressure resin laminate also provides a high degree of wear resistance and absorbs noise rather then amplifying it.

Each of the cells 19 and 20 is provided with an elongated binder, indicated generally at 22. At best seen in FIG. 1, each of the binders comprises a front leaf 23 and a rear leaf 24, preferably formed from aluminum sheet stock bent upon itself to form the two leaves, the trailing ends of the leaves being secured to a fitting 25, also preferably formed from aluminum. The front leaf 23 is configured to provide a leading tapered portion 26 which terminates in planar trailing portion 27. The front leaf is preferably covered with a piece of leather 28 or other abrasion resistant and cushioning material.

The fitting 25 at the trailing end of the binder is bifurcated and provided with a pivot pin 29 which connects the fitting to a pivot link 30 mounted on a shaft 31 which extends vertically through the shelves 10, 11 and 12, suitable attachment means 32 being provided to permit ready removal of the shaft in the event repairs to the binders are required. Preferably, non-metallic spacers 33, such as rubber or plastic bushings, will be provided on shaft 31 between the pivot links 30 and the adjacent shelves of the shuttle box; and it is also desirable to provide non-metallic bushings, such as rubber bushings 34, in the openings in shelves 10, 11 and 12 through which the shaft 31 passes, the bushings serving to cushion the parts and reduce noise.

It has also been found desirable to provide an adjustable stop toward the leading end of the binder, and to this end a shaft 35 is positioned to pass through the shelves 10, 11 and 12 in much the same manner as shaft 31, the shaft being provided with attachment means 36 by means of which the shaft may be adjustably mounted between the front and rear leaves of the binder 22. To this end, the shelves may be slotted in a direction normal to the extent of the binder, one such slot being shown at 37 in FIG. 1, the slots permitting adjusting movement of the shaft, thereby providing an adjustable stop for the leading end of the binder. The shaft 35 is surrounded by rubber bumpers **35*a* which are positioned to be contacted by the inner surfaces of the binder leaves 23 and 24**.

In accordance with the invention, a pneumatic or hydraulic cylinder 38 is mounted on front wall member 13 of the shuttle box, the cylinder having a piston 39 and a piston rod 40, the piston rod mounting at its distal end a non-metallic, preferably plastic, tip 41 position to contact the binder 22 in the area underlying pivot pin 29. A spring 42 normally biases the piston 39 and piston rod 40 to the retracted position. In similar fashion, the front wall member 14 mounts a cylinder 43 having a piston 44 and piston rod 45 mounting a non-metallic tip 46, the piston and piston rod being normally biased to the retracted position by a spring 47. Fluid under pressure is adapted to be introduced into cylinder 38 and relieved therefrom by means of pressure regulating means 48, and a similar pressure regulating means 49 is provided for cylinder 43. The pressure applying cylinders 38 and 43 are preferably of different sizes, with the cylinder acting upon the trailing end of the binder being larger, thereby permitting a higher degree of loading at the point where the binder pivots. However, the cylinders may be of the same size and, if desired, they may be jointly activated and deactivated by a single pressure regulating means. However, independent control of the cylinders is preferred, thereby providing greater flexibility in adjustment.

In the operation of the shuttle box, it is desirable to initially set each binder so that its planar trailing portion 27 lies in parallel relation to the rear wall 16 of the box. Initial adjustment may be readily affected by means of the adjustable shaft 35 lying toward the leading end of the binder, and by means of an adjustable stop 49 positioned to contact the fitting 25 in the area adjacent pivot pin 29. Preferably, the adjustment of the stops will be such that the distance between the planar portion 27 of the binder and the rear wall 16 is less than the width of the shuttle by $\frac{1}{8}$ to $\frac{3}{8}$ inch, such adjustment insuring maximum contact between the binder and shuttle. When the shuttle box is to receive a shuttle picked from the opposite side of the loom, pressure will be applied to cylinders 38 and 43, thereby forcing the binder against the stops under the desired pressure.

As the picked shuttle initially enters the shuttle box, it contacts the leading tapered portion 26, the shuttle acting to displace the binder angularly about its pivot pin 29, although the initial displacement of the binder will be resisted predominantly by the cylinder 43 underlying the leading end of the binder. To the extent that the front leaf 23 of the binder is caused to flex as it is struck by the shuttle, the rubber cushions **35*a* surrounding stop pin 35 will additionally absorb some of the shock. As the shuttle progresses further into the box, the shuttle will deflect the binder in the direction of the cylinders and also in the direction of the pivot link, the displacement of the binder causing the pivot link 30 to rotate in a clockwise direction, such movement being resisted predominantly by the cylinder 38**.

By selectively adjusting the pressure exerted on the binder by the cylinders 38 and 43, deceleration of the shuttle can be accurately controlled. Once the shuttle has been stopped, the fluid pressure to cylinders 38 and 43 is released, whereupon the springs 42 and 47 displace the pistons to their retracted positions in which they do not exert pressure on the binder. Preferably, the nonmetallic rod tips 41 and 46 should clear the binder by approximately 1/16 inch when the piston rods are in retracted position. Consequently, the shuttle is effectively free and there is no binder pressure to overcome when the shuttle is picked to the opposite side of the loom by means of the picker 3. The application of pressure to the cylinders 38 and 43 and the release of such pressure may be accomplished manually or automatically as a part of the operating cycle of the loom.

On looms employing conventional multicell shuttle boxes, the retarding force exerted by the binders had to be limited because it was necessary for the shuttle to dead-end against the resilient loom check with sufficient force to cause the shuttle to rebound in order to permit the shuttle boxes to be shifted vertically. With shuttle boxes in accordance with the present invention, while the shuttle contacts the resilient check, it does not rebound, the binder pressure being sufficient to hold the shuttle against the loom check. When the binder pressure is released, the resilient check has sufficient stored energy to gently push the shuttle into a position which will permit vertical shifting of the shuttle box.

As should now be apparent, the instant invention provides an improved shuttle box construction in which there is a gradual deceleration of the shuttle rather than impact type stopping of the shuttle as it dead-ends against the resilient loom checks. At the same time the construction of the shuttle box and its component parts is such that the noise level is materially reduced.

It will be understood that modifications may be made in the invention without departing from its spirit and purpose. Various modifications have already been set forth and others will undoubtedly occur to the worker in the art upon reading this specification. Accordingly, it is not intended that the invention be limited other than in the manner set forth in the claims which follow.

The embodiments of the invention in which an exclusive property or privilege is claimed are defined as follows:

1. A shuttle box for use with a loom on which a shuttle is picked between opposing shuttle boxes, said shuttle box having a wall surface defining one side of a shuttle receiving cell, an elongated binder defining the opposite side of said cell, said binder having a shuttle contacting surface the leading portion of which is tapered and the trailing portion of which is planar, means mounting said binder for movement toward and away from said wall surface, adjustment means for positioning said binder relative to said wall surface so that the distance between the planar portion of said binder and said wall surface is less than the width of the shuttle to be received in the cell defined therebetween, a first fluid pressure means positioned to contact the binder adjacent its tapered leading end for applying pressure to said binder in a direction to resist initial deflection of the binder by a shuttle entering said cell, and a second fluid pressure means positioned to contact the binder at its trailing end for applying pressure to said binder in a direction to resist deflection of the binder as the shuttle contacts the planar trailing portion of the binder, whereby to provide controlled gradual deceleration of the shuttle.

2. The shuttle box claimed in claim 1 wherein each of said fluid pressure means comprises a fluid cylinder having a piston and a piston rod, the piston rod being movable from a retracted position in which it is out of contact with said binder to an extended position in which it contacts and applies pressure on said binder.

3. The shuttle box claimed in claim 2 including pressure regulating means for varying the pressure applied to said binder by each said fluid cylinder.

4. The shuttle box claimed in claim 3 including means for biasing said piston and piston rod to the retracted position.

5. The shuttle box claimed in claim 1 wherein the means mounting said binder for movement toward and away from said wall surface comprises a pivot link pivotally connected to the trailing end of said binder, said pivot link being mounted on a shaft connected to said shuttle box.

6. The shuttle box claimed in claim 5 wherein said first and second fluid pressure means each comprises a fluid cylinder having a piston and a piston rod, the piston rod being movable from a retracted position to an extended position, the piston rod of one of said cylinders being aligned so as to contact said binder in the area of said pivot link, and the piston rod of the other of said cylinders being positioned to contact said binder toward its tapered leading end.

7. The shuttle box claimed in claim 6 wherein the adjustment means for positioning said binder relative to said wall surface includes a first adjustable stop means positioned to contact said binder in the area of said pivot link, and a second adjustable stop means positioned to contact said binder toward its leading end.

8. The shuttle box claimed in claim 1 wherein said shuttle box is fabricated from a non-metallic material having noise dissipating characteristics.

9. The shuttle box claimed in claim 8 wherein the means mounting said binder for movement toward and away from said wall surface includes noise damping means, and wherein noise damping means are interposed between said binder and each of said fluid pressure means.

10. The shuttle box claimed in claim 1 wherein said binder has front and rear leaves integrally joined at their leading ends, the trailing ends of said leaves being connected to a fitting pivotally connected to one end of a pivot link, the opposite end of said pivot link being pivotally mounted on a shaft connected to said shuttle box.

11. The shuttle box claimed in claim 10 wherein said adjustment means includes a first adjustable stop means positioned to contact said binder in the area of said pivot link, and a second adjustable stop means positioned between the leaves of said binder toward its leading end.

12. The shuttle box claimed in claim 11 wherein said second adjustable stop means comprise a shaft surrounded by rubber members positioned to be contacted by the inner surfaces of the binder leaves.

* * * * *